US007543798B2

(12) United States Patent
Cunningham

(10) Patent No.: US 7,543,798 B2
(45) Date of Patent: Jun. 9, 2009

(54) PORTABLE BATTERY-OPERATED WINCH WITH ELECTRICAL OUTPUTS FOR ACCESSORY DEVICES

(75) Inventor: Isaiah Cunningham, Route 2, Box 655, Milton, WV (US) 25541

(73) Assignee: Isaiah Cunningham, Milton, WV (US)

( * ) Notice: Subject to any disclaimer, the term of this patent is extended or adjusted under 35 U.S.C. 154(b) by 0 days.

(21) Appl. No.: 11/826,152

(22) Filed: Jul. 12, 2007

(65) Prior Publication Data

US 2008/0023681 A1 Jan. 31, 2008

Related U.S. Application Data

(60) Provisional application No. 60/833,811, filed on Jul. 28, 2006.

(51) Int. Cl.
*B66D 1/00* (2006.01)

(52) U.S. Cl. ..... 254/266; 254/279; 191/12.2 R

(58) Field of Classification Search ..... 254/266, 254/278, 279, 323, 328, 362; 191/12.4, 12.2 R
See application file for complete search history.

(56) References Cited

U.S. PATENT DOCUMENTS 4,884,784 A 12/1989 Nix et al.
5,327,592 A * 7/1994 Stump ..... 5/81.1 R
5,474,278 A 12/1995 Cleveland
5,511,929 A 4/1996 Loftus
5,522,582 A * 6/1996 Dilks ..... 254/323
5,657,841 A * 8/1997 Morvan ..... 191/12.4
5,678,805 A * 10/1997 Moser et al. ..... 254/279
5,690,198 A * 11/1997 Lohr ..... 191/12.2 R
5,913,487 A * 6/1999 Leatherman ..... 242/378.4
6,223,871 B1 * 5/2001 Steffen ..... 191/12.4
6,241,215 B1 6/2001 Gersemsky et al.
6,371,449 B1 * 4/2002 Chamberlain ..... 254/387
6,386,514 B1 * 5/2002 Ray ..... 254/323
6,523,806 B2 * 2/2003 Bartal ..... 254/323
6,561,489 B1 * 5/2003 Wakefield ..... 254/323
6,595,495 B1 * 7/2003 Hung ..... 254/326
6,758,314 B2 * 7/2004 Woodruff ..... 191/12.2 R
7,059,588 B2 * 6/2006 Goulet ..... 254/323
7,114,603 B2 * 10/2006 Lai ..... 191/12.4
7,227,322 B2 * 6/2007 Alipour et al. ..... 318/281
7,311,298 B2 * 12/2007 Giacomini ..... 254/323
2006/0284153 A1 * 12/2006 Burns ..... 254/323
2007/0221898 A1 * 9/2007 Giacomini et al. ..... 254/323

* cited by examiner

*Primary Examiner*—Emmanuel M Marcelo
(74) *Attorney, Agent, or Firm*—Jean C. Edwards, Esq.; Akerman Senterfitt

(57) ABSTRACT

A portable winch apparatus having a rechargeable battery and electrical outlets for the charging and operation of external accessory devices. The winch is housed in a casing with various anchor attachments that allow for multiple dragging, towing, and lifting arrangements. Because the winch apparatus incorporates at least one accessory outlet which is powered by the attached rechargeable battery power supply, the present invention combines the portability advantages of hand held winches with the power output options available to vehicle mounted winches. The invention achieves further versatility through incorporation of a wireless remote control unit, and its versatile structural organization around an internal frame that permits it to be manufactured in differing configurations with different geometries.

18 Claims, 5 Drawing Sheets

PORTABLE BATTERY-OPERATED WINCH WITH ELECTRICAL OUTPUTS FOR ACCESSORY DEVICES

CROSS-REFERENCE TO RELATED APPLICATIONS

The present application claims priority from U.S. Provisional Patent Application No. 60/883,811, filed Jul. 28, 2006, the contents of which are herein incorporated by reference in its entirety.

FIELD OF THE INVENTION

The present invention relates to a portable winch, and more particularly, to a portable winch apparatus with a self-contained rechargeable battery power supply that powers not only the winch motor, but also a series of electrical outlets incorporated into the winch apparatus that are suitable for charging and operating accessory devices, and to a method for the operating same.

BACKGROUND OF THE INVENTION

The use of winches for pulling, towing, and lifting is well known in the prior art. Portable winches have advantages over fixed winches because they can be transported to an array of different job sites, both indoors and outdoors, and because they can be configured ad hoc in alternate ways, such as suspended from a ceiling anchor in order to lift an object, or attached to a vehicle in order to tow an object. Winches achieve portability by being light enough to carry by hand or by being designed for mounting on a vehicle.

U.S. Pat. No. 5,511,929 and No. 6,386,514 are compact winches intended to be mounted on automobiles. Vehicle-mounted winches are easily transported to disparate locations, but are nevertheless limited in the range of sites at which they can be utilized, due to the accessibility requirements of the vehicle. Essentially, the winch can only be utilized where the vehicle can be driven, preventing use of the portable winch at many off-road locations, confined spaces, or hazardous positions where a vehicle would be at risk for damage. U.S. Pat. No. 5,522,582 is a vehicle mounted winch that incorporates a remote control unit, allowing a person to stand clear of the winch during operation, but the access limitations of the vehicle remain.

U.S. Pat. No. 6,241,215 is a portable, battery powered winch having the dimensions of a large suitcase that does not require mounting on a vehicle. A hook protruding from the top surface serves to attach the device to a fixed object in the environment, while the traction member extends from the opposite, lower surface for pulling a load. The invention is light enough to be carried by a single person and it has a self-contained design that makes it suitable for a wide range of applications in the domestic sector. It may also be powered by remote control, allowing the user to stand clear of the device during operation.

Further, U.S. Pat. No. 5,474,278 covers a winch apparatus mounted to a backpack frame, powered by a gasoline engine and a hydraulic pump, thus having a greater range of portability than any vehicle-mounted winch. Similarly, U.S. Pat. No. 4,884,784 is directed to a compact hand-held battery-operated winch that is powered by a series of six small batteries. In both inventions, the user may carry the winch to any desired location, where it is anchored to a fixed object in the environment such as a tree or post. The traction member is then attached to a load which is pulled towards the apparatus as the winch motor turns the winch drum to spool the cable.

Although freely portable winches, such as U.S. Pat. Nos. 6,241,215 and 5,474,278 above, gain range by virtue of the fact that they are not attached to a vehicle, they lose the benefit of the vehicle's other commonly included tools such as headlights, radio, GPS positioning system, and vehicle accessory outlet (i.e., cigarette lighter adapter). These ancillary tools enhance the utility of portable vehicle-mounted winches by providing, for example, illumination at night, communication with rescue services, and mapping functions to facilitate access to remote locations.

Currently, there are no portable winches that can take advantage of the plurality of accessories commonly provided with a vehicle or carried by a user. Therefore, a user operating a portable winch and desiring to operate an accessory device in conjunction therewith must carry at least one additional power source to either operate or charge the accessory device, causing considerable inconvenience, especially at remote locations.

SUMMARY OF THE INVENTION

The present invention relates to an improved portable, rechargeable battery-operated winch, that is wirelessly remote-controlled, and that provides adaptors to power and operate accessory devices. The present invention also encompasses a method for configuring a plurality of said portable winches to operate in parallel in order to achieve greater force when towing, pulling, or lifting a load.

The functional components of the present apparatus include a portable electric winch with a wireless remote control apparatus, a rechargeable battery power supply, and a series of power outlets allowing external accessory devices to draw current from the power supply. The functional components are mounted on an support frame and encased in a cover made of plastic, metal, or other durable material.

This basic arrangement can be modified to alter the geometry of the apparatus, to allow different modes of storage and portability, or to include further functional components. For example, in one preferred embodiment, substantially all of the functional components are mounted on one side of a rectangular support frame, with the opposite side being flat. The encased apparatus has a shallow rectangular box shape that can be easily stored on a shelf or mounted flush against a wall. In an alternative embodiment, the functional components can be mounted on two sides of a smaller support frame, occupying more depth but less length. This embodiment can be encased in a more rounded external casing with fewer sharp edges, making it safer to carry by hand through rugged terrain. Handles may be attached to the device for ease of portability. Ultimately, user preference will determine which embodiment is best suited for a particular task.

The present invention offers the full portability of a hand-held electric remote-controlled winch, combined with substantially the same electrical power output options associated with vehicle-mounted winches which utilize vehicle batteries. The power output options of the present invention can replicate those of a vehicle because the internal rechargeable battery power supply is connected to at least one electrical output member, such as a vehicle accessory outlet (i.e., 12 volt cigarette lighter adapter), a universal serial bus (USB) port, and a pair of battery contacts for jumpstarting a vehicle.

Embodiments of the present invention having at least one vehicle accessory outlet can provide electrical power to any of hundreds of accessory devices already commercially available for use in association with automobiles. These include but are not limited to spotlights, radios, handheld computers, cellular phones, and GPS navigation devices.

The present portable electric winch apparatus may also have variable internal accessories that are installed during manufacture. For example, in one embodiment, an air compressor, powered by the internal rechargeable battery power supply, is mounted on the support frame with the other functional components of the apparatus. Thus, the present invention replicates substantially the same functionality as a fully portable winch, a portable battery power supply, a vehicle accessory outlet, and an emergency roadside assistance kit, in a single compact device.

Being fully portable, the present invention provides more operational versatility than any vehicle-mounted portable winch. It may be operated in any orientation, either flat on the ground or suspended from an elevated anchor point. Also, as stated above, the winch motor may be controlled using a wireless remote control unit. These factors permit using the present apparatus in any location where an anchor point can be found, including hazardous or difficult-to-access sites such as over a body of water, near fire, or on a cliffside.

Having a reliable and versatile power supply associated with the winch of the present invention can enhance its safe and effective use, by enabling simultaneous operation of a wide range of peripheral electronic devices and accessories.

The foregoing summary has outlined some features consistent with the present invention in order that the detailed description thereof that follows may be better understood, and in order that the present contribution to the art may be better appreciated. There are, of course, additional features consistent with the present invention that will be described below and which will form the subject matter of the claims appended hereto.

In this respect, before explaining at least one embodiment consistent with the present invention in detail, it is to be understood that the invention is not limited in its application to the details of construction and to the arrangements of the components set forth in the following description or illustrated in the drawings. Methods and apparatuses consistent with the present invention are capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the methods and apparatuses consistent with the present invention.

DETAILED DESCRIPTION OF THE EXEMPLARY EMBODIMENTS

Figure 1:
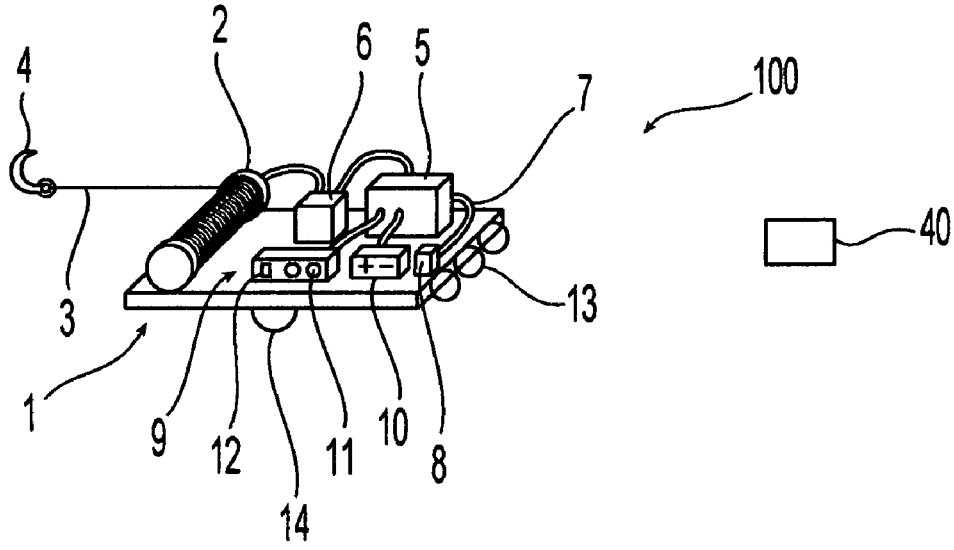
FIG. 1 is a perspective view of an electric winch according to a first embodiment consistent with the present invention, in open plan, showing a flat rectangular structural frame with substantially all the functional components mounted on one surface.

Throughout all the Figures, same or corresponding elements are generally indicated by same reference numerals.

As depicted in FIGS. 1-9, the portable apparatus 100 of the present invention includes generally a structural frame 1 to which are attached at least the following functional components: an electrically powered winch 2, a rechargeable battery power source 5, and at least one of a vehicle accessory outlet 11 to supply power from said battery power source 5 to at least one of a number of peripheral electrical devices 40 already commercially available for use in association with automobiles. These include but are not limited to spotlights, radios, handheld computers, cellular phones, and GPS navigation devices (not shown). Additional functional components may be mounted to the support frame to provide other capabilities commonly associated with emergency roadside assistance, outdoor activities, and travel utilities, such as an air compressor (not shown).

A remote control unit 6 may be included to allow wireless control of the winch. The winch may be of any standard configuration known to those skilled in the art, and will generally include an electric motor powered by direct current (DC) or alternating current (AC), a gearbox, and a roller for winding and unwinding a traction member, wherein the traction member may be a cable, chain, synthetic rope, or the like. The traction member 3 will typically have an attachment mechanism or means 4 at the distal end thereof, for attachment of a load bearing member, which is typically a hook 4. In one example, a self-contained, off-the-shelf winch may be used, such as the Ramsey ATV 3000 (Ramsey Winch Company) and other commercially available like winches.

FIG. 1 depicts a first embodiment consistent with the present invention in which the structural frame 1 is a flat rectangle with all functional components mounted on one surface. The frame 1 may be of any durable material, such as metal or plastic, etc. An electric winch 2 is mounted on the structural frame 1. The internal motor of the winch is driven by the rechargeable battery power supply 5. The rechargeable battery power supply 5 may include a single battery or a series of batteries. The operation of the winch motor may be controlled by a remote control unit 6 that includes a remote control receiver and which responds to wireless signals from a remote control transmitter (not shown). A power cord 7 ends in a plug 8 which allows connection to an AC power source for both charging the battery of the power supply 5 and powering the winch motor.

The rechargeable battery power supply 5 may be further connected to a series of plugs, jacks, or outlets collectively termed the accessory interface 9. The accessory interface 9 may include at least one vehicle accessory outlet (i.e., a 12 volt cigarette lighter adapter) 11, and may also include a universal serial bus port (USB) 12 for connection to USB-chargeable devices via their separate USB charging cables. The accessory interface 9 may further include a pair of battery contacts 10 that are coupled to the rechargeable battery power supply 5 and are suitable for jumpstarting a vehicle (not shown) as is performed with a standard automobile battery.

The structural frame 1 may incorporate at least one anchoring member 13 sufficient to serve as an anchor point to hold the apparatus 100 in place during operation. The anchoring member 13 may be a hole punched through the support frame 1, a loop attached to same, or any other mechanism or means for joining or tethering the apparatus 100 to a fixed object in the environment.

The traction member 3 extends from the opposite side of the frame 1. Although the instant embodiment shows the electric winch 2 positioned closest to the side of the support frame 1 from which the traction member 3 protrudes, in other embodiments this orientation may be reversed such that the winch 2 is mounted on the opposite side of the support frame 1 from where the traction member 3 protrudes. The anchoring member 13 may also serve as a carrying handle; or, at least one carrying handle 14 may be attached anywhere on the portable winch apparatus 100 for ease of portability.

Figure 2:
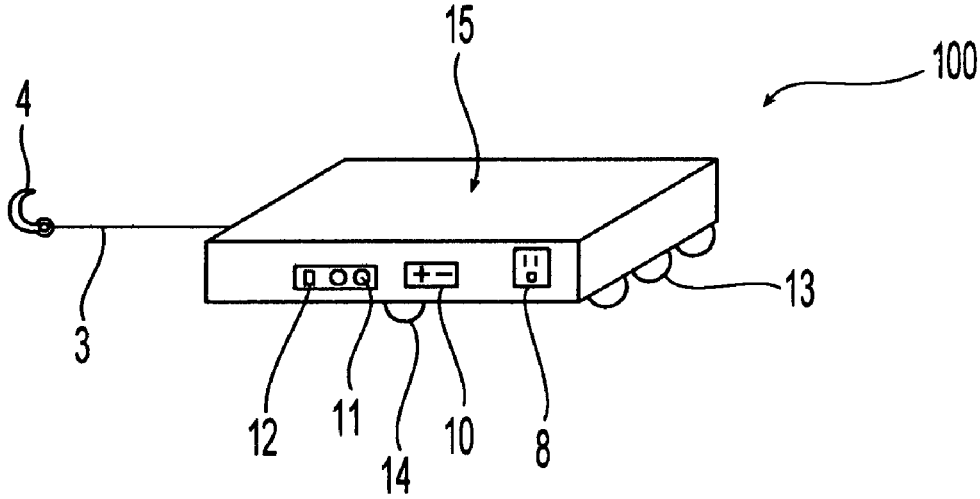
FIG. 2 is a perspective view of an electric winch according to FIG. 1, where the components are enclosed in an outer casing.

FIG. 2 depicts the embodiment of FIG. 1 enclosed in a protective casing 15, the casing being constructed of plastic, metal, or other durable material. Openings in the casing 15 allow access to the accessory device connection sockets 10, 11, 12 and the AC adapter plug 8 at the distal end of cable 7. The anchoring members 13 protrude outside of the casing 15. A carrying handle 14 may be attached to the frame 1 or to the outer casing 15 for ease of portability. In this embodiment, the traction member 3 is seen protruding from one side while the anchoring members 13 are disposed on the opposite side.

Figure 3:
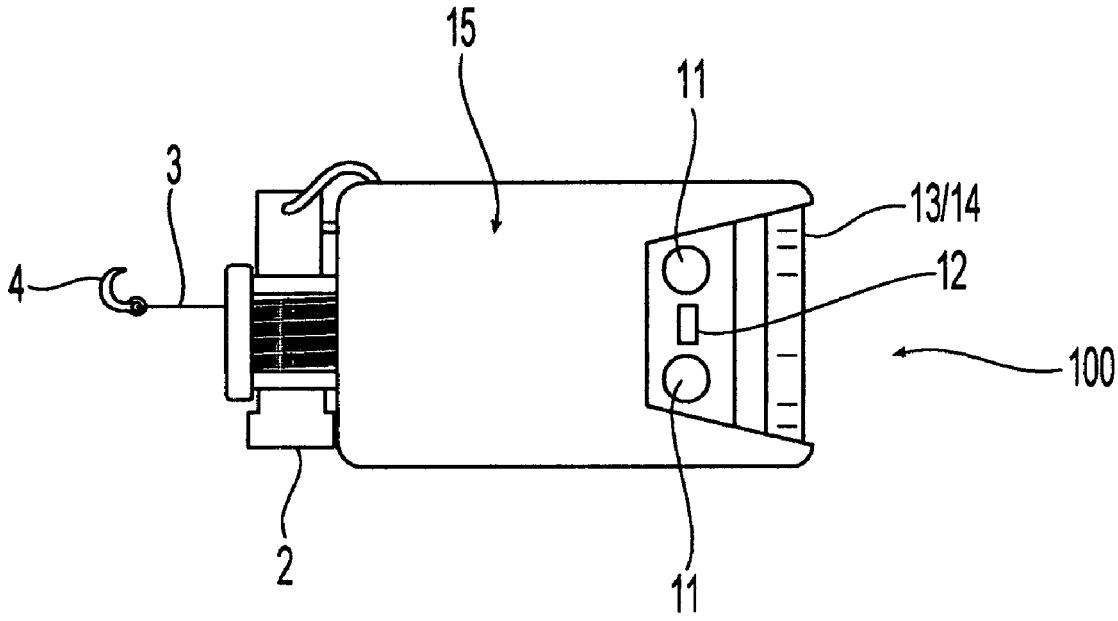
FIG. 3 is a top view of another embodiment consistent with the present invention.

FIG. 3 depicts another embodiment of the present invention with the components partially enclosed in a protective casing 15, the casing being constructed of plastic, metal, or other durable material. The electrical winch 2, traction member 3, load bearing member 4, and support frame (not shown) are exposed, while other functional components are encased. A single handle 14 is attached to the apparatus opposite the winch, said handle also serving as an anchoring member 13. Electrical outlets are accessible, including two 12 volt vehicle accessory adaptors 11 and a single USB port 12.

Figure 4:
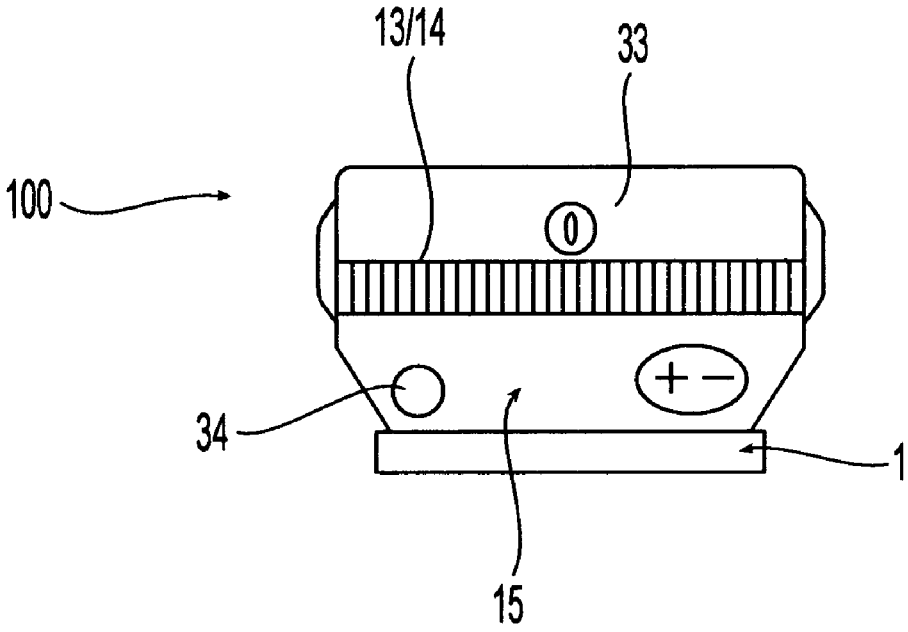
FIG. 4 is an end view of another embodiment consistent with the present invention.

FIG. 4 depicts an end view of another embodiment of the present invention with the components partially enclosed in a protective casing 15, the casing being constructed of plastic, metal, or other durable material. The functional components are attached to the top surface of support frame 1. A manual control switch 33 controls power to the winch, having an intermediate postion for off, and having alternative positions to either extend (out) or retract (in) the traction member. The anchoring member 13 in this embodiment doubles as a carrying handle 14 and is disposed below the switch 33. Openings in the outer casing 15 allow access to battery contacts 10 and a port 34 suitable for passage of an air hose from an air compressor situated within the casing (not shown).

Figure 5:
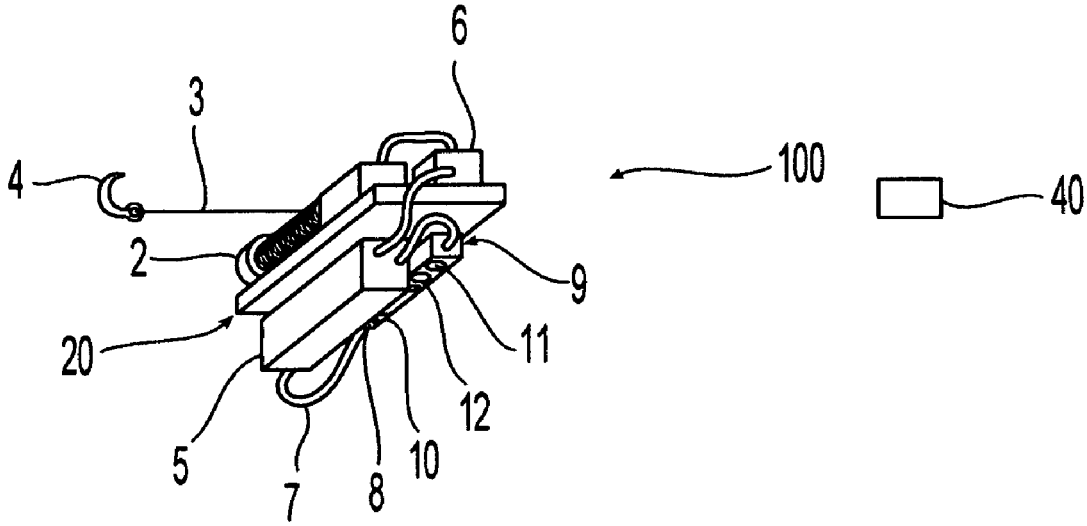
FIG. 5 is a perspective view of an electric winch according to a second embodiment consistent with the present invention, in open plan, showing a narrower structural frame with functional components mounted on at least two of the frame's surfaces.

FIG. 5 depicts an alternative or second embodiment of the present invention in which the structural frame 20 is a more compact rectangular or square platform or rod with functional components mounted on a plurality of its surfaces. The layout of the components is generally the same as in the embodiment of FIG. 1, except that the functional components may be on different sides of the support frame 20.

An electric winch 2 is mounted on the structural frame 20 and connected through the frame 20, to the rechargeable battery power supply 5 which may be on the opposite side of the structural frame 20. The rechargeable battery power supply 5 may be a single battery or a series of batteries as described above. The electrical input to the winch 2 may be controlled by a remote control unit 6 that includes a remote control receiver and which responds to wireless signals from a remote control transmitter (not shown). A power cord 7 with plug 8 allows connection to an AC power source for both charging the battery and powering the winch motor.

The rechargeable battery power supply 5 is further connected to an accessory interface 9 as in the first embodiment described in FIG. 1, and may include at least one vehicle accessory outlet 11. As described above, the accessory interface 9 may also include a universal serial bus port (USB) 12 for charging and operating USB-powered devices, and may further comprise a pair of battery contacts 10 that are coupled to the rechargeable battery power supply 5 and are suitable for jumpstarting a vehicle (not shown).

As with the first embodiment, the structural frame 20 incorporates at least one anchoring member 13 sufficient to serve as an anchor point to hold the apparatus 100 in place during operation. The anchoring member 13 may be a hole punched through the support frame 20, a loop attached to the same, or any other means for joining or tethering the apparatus 100 to a fixed object in the environment. The traction member 3 extends from the opposite side of the frame 20 and has a load bearing member 4 attached to its distal end. As in the previous embodiment, an anchoring member 13 may also serve as a carrying handle, or, at least one of a carrying handle 14 may be attached anywhere on the portable winch apparatus 100.

Figure 6:
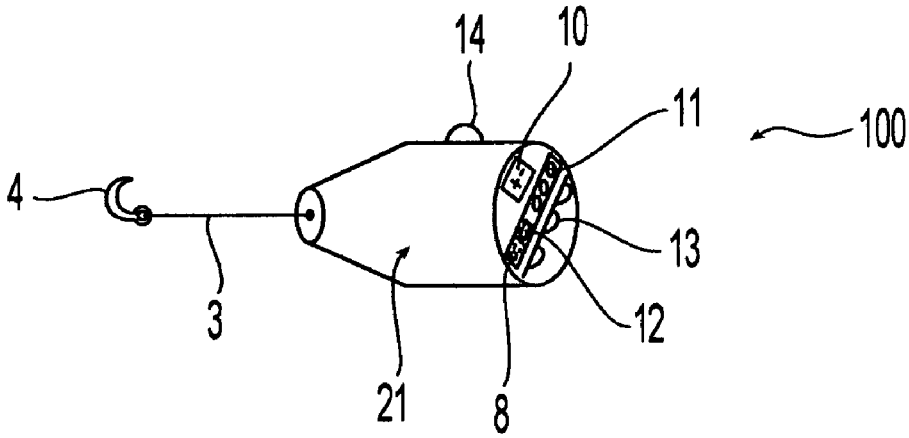
FIG. 6 is a perspective view of an electric winch according to FIG. 3, where the components are enclosed in an outer casing.

FIG. 6 depicts the second embodiment of the present invention, showing the winch apparatus 100 enclosed in a protective casing 21 constructed of plastic, metal, or other durable material. The casing 21 is shown as a rounded, cylindrical shape, but may also be square or rectangular. In this embodiment, the width of the apparatus 100 is similar to that of the first embodiment shown in FIG. 2, but the length is reduced. Openings in the casing 21 allow access to each of the accessory device connection sockets 10-12 and the AC adapter plug 8. The anchoring members 13 protrude outside of the casing 21. The carrying handle 14 may be attached to the frame 20 or to the outer casing 21. In this embodiment, the traction member 3 with attached load bearing member 4 is seen protruding from one side while the anchoring members 13 are on the opposite side.

Figure 7:
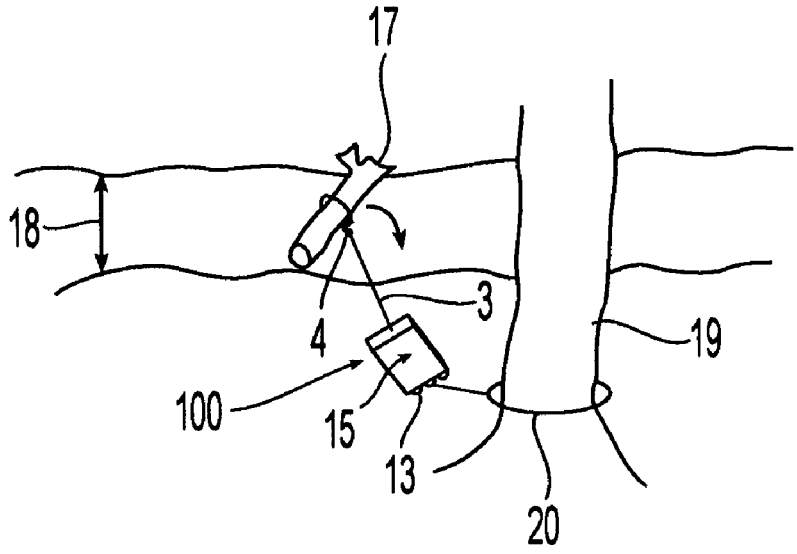
FIG. 7 depicts the electric winch of the first embodiment in an operational setting, being used to pull a log off of a trail.

FIG. 7 depicts the first embodiment of the present invention, identifiable from the boxlike shape of its outer casing 15, in one example, being used to remove an obstacle 17, in this case a log 17, from a trail 18. The fact that the portable winch apparatus 100 is not mounted on a vehicle permits it to be positioned to the side of a trail 18 so that the obstacle 17 can be dragged directly off of the trail, whereas if the winch apparatus 100 were mounted an a vehicle, the obstacle 17 could only be pulled in the direction of that vehicle.

In preparation for removing the log 17, the portable winch apparatus 100 is anchored to a fixed object in the environment, in this case a tree trunk 19, to which the log 17 will be dragged. Anchoring to the tree trunk 19 is achieved by attaching any suitable tether 20 such as a rope, strap, chain, or cable, to at least one anchoring member 13 of the apparatus 100. The traction member 3 is attached using the load bearing member 4 to the log 17. When the winch apparatus 100 is activated, the log 17 is pulled towards the winch apparatus 100 as the traction member 3 is taken up by the spool of the winch 2.

Figure 8:
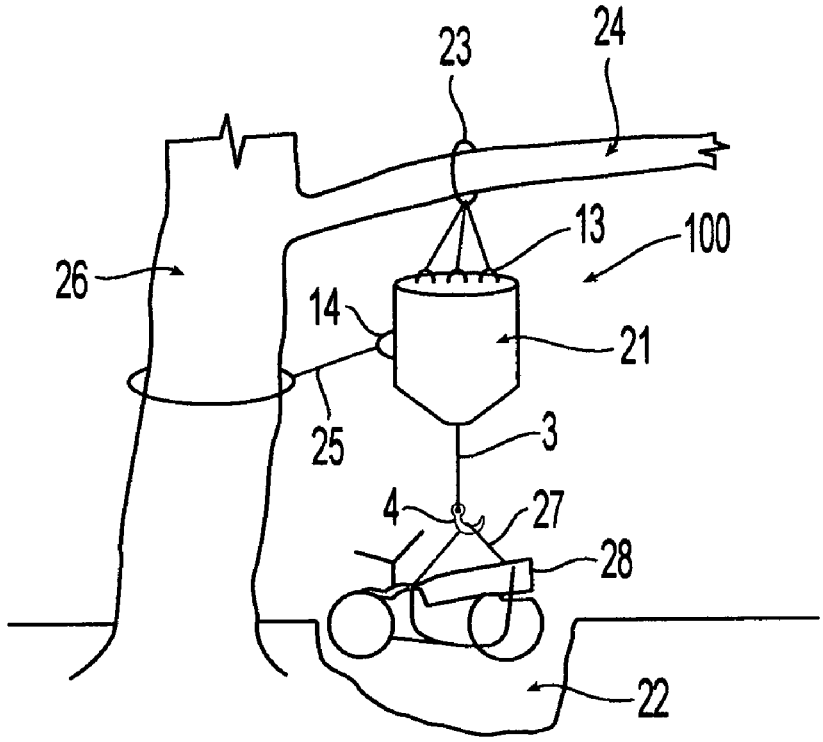
FIG. 8 depicts the electric winch of the second embodiment of the present invention, in an operational setting, being used to lift a stranded all terrain vehicle out of a ditch.

FIG. 8 depicts the second embodiment of the present invention, identifiable from the cylindrical shape of its outer casing 21, in one example, being used to lift a stranded ATV 28 from a ditch 22. Although the Figures depict particular embodiments of the present invention performing particular tasks, each embodiment is competent to perform all of the same tasks, and the application of different embodiments of the invention to particular tasks will be determined by the individual preference of each end user of the apparatus.

In this example, the winch apparatus 100 is anchored via a suitable tether 23 attached between anchoring members 13 and an overhanging tree branch 24. A second stabilizing tether 25 is attached between a carrying handle 14 and the tree trunk 26 to further prevent swaying of the suspended portable winch apparatus 100. The traction member 3 is fastened by its load bearing member 4 to straps 27 wrapped around the chassis of the ATV 28. When the winch 2 is activated, the ATV 28 is pulled upwards out of the ditch. It can then be lowered to the side of the ditch by detaching the stabilizing tether 25 from the tree trunk 26, and then by pulling the ATV 28 in a desired direction away from the ditch while simultaneously letting out a length of traction member 3 from the winch spool.

Figure 9:
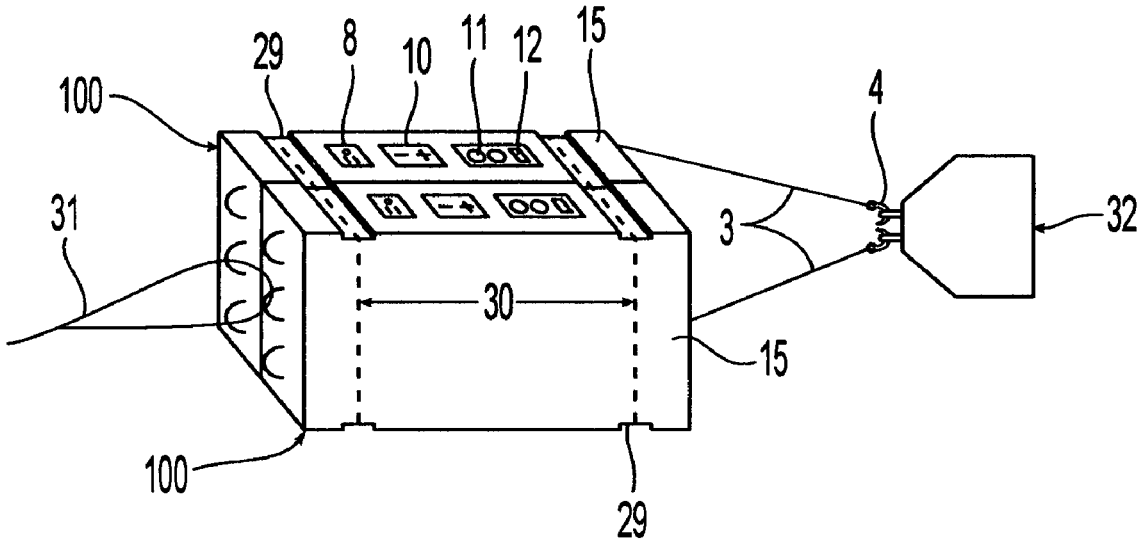
FIG. 9 depicts a plurality of electric winches of the present invention, operating in parallel, in order to multiply the force applied to the load.

FIG. 9 illustrates a present portable winch apparatus 100 of a third embodiment consistent with the present invention, including multiple units acting in parallel, called the "in-parallel" configuration. The in-parallel configuration multiplies the pulling or towing force applied to a load. The first embodiment, shown in FIGS. 2 and 7, is particularly amenable to this in-parallel configuration because each individual apparatus 100 can be placed flush one on another, along one of the long flat sides of the box-like outer casing 15. Grooves or guides 29 may be engineered into the outer casing 15 to further assist in securely aligning multiple apparatuses, such that a strap, shown as a dashed line 30 can be firmly and stably wound around the apparatus 100 through the grooves or guides 29. Alternatively, these groove guides 29 may be attached to the support frame 1 or may be replaced with clips or other means of attachment for one apparatus 100 to another. The two apparatuses are anchored as described in FIGS. 7 and 8, such as by attaching a suitable tether 31 between a fixed object in the environment (not shown) and the anchoring members 13 of one or each apparatus. The traction members 3 of each winch apparatus are attached using their respective load bearing members 4 to a load 32. Because the appliance interfaces 8-12 are aligned on the side faces of each apparatus 100, they remain accessible when applying the in parallel configuration.

Simultaneous operation of any number of the present portable winch apparatus 100, and in any embodiments or combination of embodiments, would be readily apparent to one of ordinary skill in the art. In such cases, the apparatuses 100 may be spaced a slight distance apart while being attached between the same or different anchors and a common load.

For larger or heavier or oddly shaped loads, it may be desirable to utilize a block and tackle arrangement wherein the load is fastened to a block, and the traction member is attached to the block for towing or pulling (not shown). Such a block and tackle arrangement can be applied to a single portable winch apparatus 100 operating alone or to multiple portable winches 100 arranged in the "in-parallel" configuration.

It should be emphasized that the above-described embodiments of the invention are merely possible examples of implementations set forth for a clear understanding of the principles of the invention. Variations and modifications may be made to the above-described embodiments of the invention without departing from the spirit and principles of the invention. All such modifications and variations are intended to be included herein within the scope of the invention and protected by the following claims.

What is claimed is:

1. A portable winch apparatus comprising:

a support frame;

an electrically powered winch disposed on said frame;

a rechargeable battery power source disposed on said frame;

at least one power outlet connected to said rechargeable battery power source; and a pair of battery contact bolts accessible through said outer casing and suitable for jump-starting a vehicle using a charge from said power source.

2. The portable winch of claim 1, wherein the power outlet is adapted to provide a connection to at least one of a spotlight, a worklight, a radio, a global positioning system device, a laptop computer, a personal digital assistant, a cellular phone, an air compressor, and a handheld electronic device.

3. The portable winch of claim 2, wherein said power outlet further comprises a universal serial bus (USB) port.

4. The portable winch of claim 1, wherein said winch, said power source, and said outlet comprise functional components, and said functional components are mounted to a single side of the support frame.

5. The portable winch of claim 1, wherein said winch, said power source, and said outlet comprise functional components, and said functional components are mounted to two surfaces of the support frame.

6. The portable winch of claim 5, further comprising:

an outer casing, encasing at least a portion of said functional components.

7. The portable winch of claim 6, wherein said outer casing is perforated to allow plugs and cables to be inserted through said casing and into power interfaces in said power source.

8. The portable winch of claim 1, wherein the support frame comprises:

at least one anchoring member for securing the apparatus to an external fixed object.

9. The portable winch of claim 8, wherein the anchoring member comprises:

at least one of a handle or a loop attached to the support frame.

10. The portable winch of claim 1, wherein the rechargeable battery power source receives power from an alternating current power source.

11. The portable winch apparatus of claim 1, wherein said battery contact bolts may be connected to a separate external battery in order to charge said rechargeable battery power supply.

12. The portable winch apparatus of claim 1, further comprising a remote control unit capable of responding to wireless signals from a remote transmitter to power said winch.

13. A portable winch system comprising:

a plurality of portable winch apparatuses, each comprising:

a support frame;

an electrically powered winch disposed on said frame;

a rechargeable battery power source disposed on said frame;

at least one power outlet connected to said rechargeable battery power source; and an outer casing;

wherein said winch apparatuses are disposed proximate to one another, and connected to one another, to operate in parallel.

14. The portable winch system of claim 13, further comprising:

a plurality of straps; and a plurality of guides disposed in said outer casing;

wherein said straps are disposed in said guides to connect said winch apparatuses together.

15. The portable winch system of claim 13, further comprising:

a block and tackle apparatus; and at least one traction member for each of said winch apparatuses, said traction members which are used to attach said winch apparatuses to a target object using said block and tackle apparatus.

16. The portable winch system of claim 13, wherein the power outlet is adapted to provide a connection to at least one of a spotlight, a worklight, a radio, a global positioning system device, a laptop computer, a personal digital assistant, a cellular phone, an air compressor, and a handheld electronic device.

17. The portable winch system of claim 16, wherein said power outlet further comprises a universal serial bus (USB) port.

18. The portable winch system of claim 13, further comprising a remote control unit capable of responding to wireless signals from a remote transmitter to power said winch apparatuses.

* * * * *